United States Patent [19]

Page

[11] Patent Number: 4,572,562

[45] Date of Patent: Feb. 25, 1986

[54] LIFTING SLING

[75] Inventor: Dennis J. Page, Kelso, Wash.

[73] Assignee: P & H Logging Co., Inc., Kelso, Wash.

[21] Appl. No.: 722,539

[22] Filed: Apr. 12, 1985

[51] Int. Cl.[4] ..... B66C 1/18

[52] U.S. Cl. ..... 294/74; 294/82.11

[58] Field of Search ..... 294/74, 75, 76, 77, 294/78, 82.11; 24/122.3, 122.6; 87/8

[56] References Cited

U.S. PATENT DOCUMENTS 2,354,280 7/1944 Russell ..... 294/74

3,503,646 3/1970 Solomon ..... 294/74

*Primary Examiner*—James B. Marbert

*Attorney, Agent, or Firm*—Lee R. Schermerhorn

[57] ABSTRACT

An arcuate channel member has a detachable connection at mid length with an object to be lifted. The channel member provides a guide track for sliding movement of the lower portion of a flexible cable sling loop, the upper portion of which is lifted by a hook or grapple or the like. By sliding the loop in this guide track from time to time the lifting hook or grapple does not sharply bend the sling loop at the same point in every lifting operation, thereby greatly prolonging the life of the sling loop.

1 Claim, 5 Drawing Figures

LIFTING SLING

This invention relates to a sling for lifting heavy objects by a hook or grapple suspended from a crane or other available lifting apparatus.

BACKGROUND OF THE INVENTION

Although the invention is not limited to any particular field of use, it is of particular advantage in the logging industry. Logs are usually carried from the forest to some destination such as a sawmill or railroad station by a log trailer pulled by a log truck. When the trailer has been unloaded at such destination it is usually not pulled behind the truck back up the logging road for its next load of logs, but instead is disconnected from the truck and lifted onto the truck for the trip back. Thus, a log trailer is useful in only one direction of travel and always returns empty.

The empty log trailer is usually lifted onto the truck by a wire rope sling suspended from a crane hook or grapple. Such hook or grapple produces a sharp bend in the upper portion of the sling causing the wire rope to wear out quickly at that point, in view of the fact that the truck and trailer may make several and sometimes many empty return trips every working day depending upon the travel time between the source of the logs and the unloading destination. There is a need to provide some way to extend the working life of such slings so that they will not have to be replaced as frequently as is presently necessary.

SUMMARY OF THE INVENTION

According to the present invention the lower part of the sling may be shifted from time to time through an arcuate guide track on the connection with the part to be lifted so that the same point on the upper part of the sling is not always engaged with the lifting hook or grapple on the crane. Thus the intense bending stress imposed on the upper portion of the sling loop is shifted from point to point around the length of the sling loop in the continued use of the sling. This extends the useful life of the sling to many times the useful life of the conventional type of sling.

At the same time, the arcuate guide track which engages the lower part of the sling loop is of sufficient radius of curvature to avoid any excessive bending stress at this point. To provide for sliding movement of the sling loop in the arcuate guide track, the opposite ends of the wire cable forming the sling loop are coupled together to make an endless loop of cable. In preparation for each lifting operation the cable may be pulled a short distance through the guide track to present a different point on the cable to the lifting hook or grapple.

DESCRIPTION OF THE PREFERRED EMBODIMENT

Figure 1:
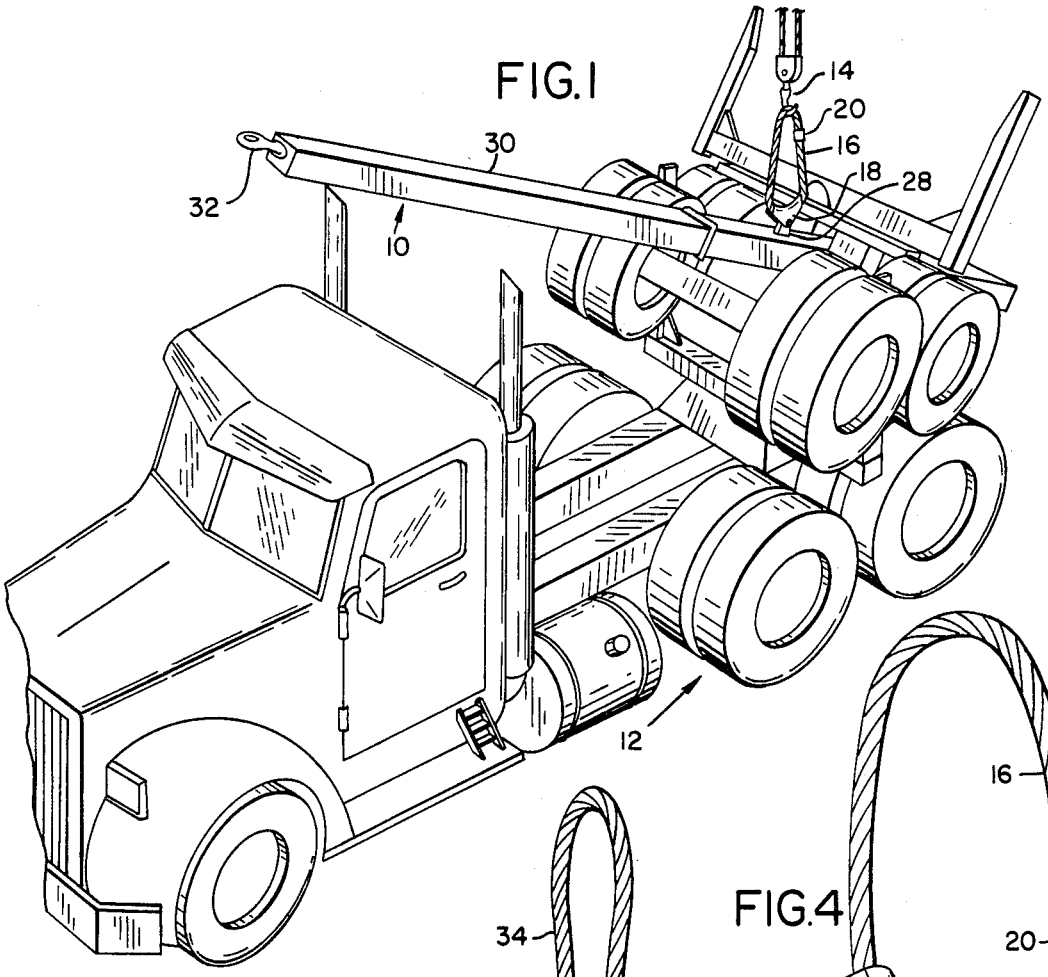
FIG. 1 is a perspective view showing an empty log trailer being lifted onto a log truck by the present sling loop.

In FIG. 1 the log trailer 10 is being lifted onto truck 12 by crane hook 14 after a load of logs has been unloaded from the trailer. The upper part of wire rope sling loop 16 is sharply bent over crane hook 14 while the lower part of the sling loop is bent to a relatively long radius of curvature in the arcuate guide track 18. The ends of wire rope 16 are fastened together in coaxial relation with a conventional coupling 20 to make an endless sling loop which will slide in the guide track 18.

Figure 3:
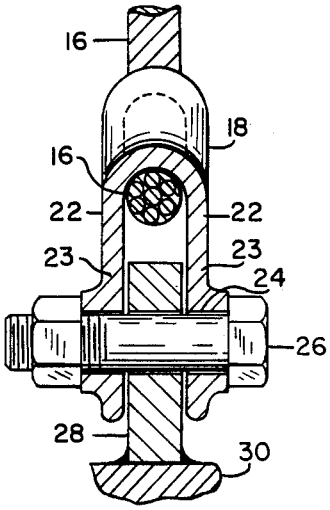
FIG. 3 is a section view on the line 3—3 in FIG. 2.
Figure 2:
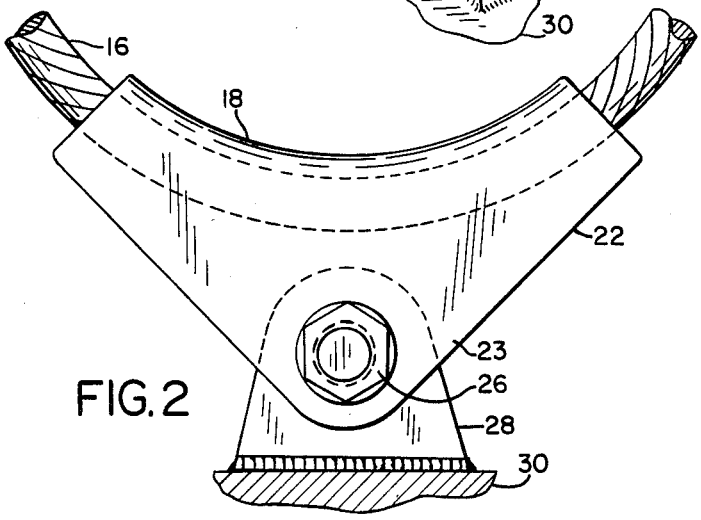
FIG. 2 is a side elevation view showing the arcuate guide track at the lower end of the loaded sling loop in FIG. 1.

As seen in FIG. 3 the guide track 18 is of channel shape in cross section having opposite side walls 22 with projecting ears 23 which are apertured at 24 to receive a bolt 26 in an upstanding apertured ear 28 on the trailer reach pole 30. Thus, the guide track 18 holds the sling loop 16 in upstanding position in a vertical plane for engagement by the lifting hook 14. When lifting hook 14 is disengaged from sling loop 16 the pivot bolt 26 allows the guide track 18 and sling loop to tilt forward against the top surface of reach pole 30 and when the trailer is loaded with logs the logs will deflect the sling loop without any damage to the sling loop because of the resilient and springy nature of the wire cable.

Thus the sling loop 16 may be shifted through its arcuate guide track 18 from time to time to shift the point of engagement of the sling loop with lifting hook 14 in FIG. 1. When this periodic rotation of the sling loop brings coupling 20 to one end of the channel forming the arcuate guide track 18 the sling loop is shifted step by step in the opposite direction until coupling 20 has shifted around to the opposite end of the guide track channel. If the channel guide track is wide enough to receive coupling 20, the sling loop may be shifted continuously in one direction.

At the loading station the lifting operation shown in FIG. 1 is repeated to remove the trailer 10 from truck 12. Then the trailer reach pole coupling 32 is connected to the rear of the truck and the trailer is ready for loading with logs. Thus each trip with a load of logs and an empty return trip requires two lifting operations as shown in FIG. 1 which is very damaging to the wire cable in the sling loop if lifting hook 14 engages the cable at the same point in each lifting operation.

Figure 5:
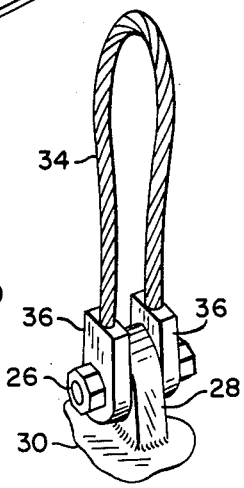
FIG.5 Prior Art
FIG. 5 is a perspective view showing a conventional type of lifting sling.

This is illustrated in the conventional sling loop 34 in FIG. 5. The opposite ends of a short length of wire cable are connected to apertured blocks 36 which receive the bolt 26 in the apertured ear 28 on trailer reach pole 30.

Figure 4:
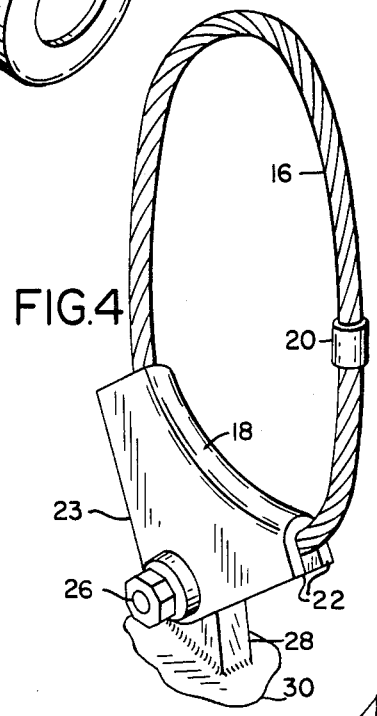
FIG. 4 is a perspective view showing the sling loop assembled in its arcuate guide track.

Another advantage of arcuate guide track 18 is that it holds the empty sling loop 16 open in a vertical plane as shown in FIG. 4 for convenient engagement by crane hook 14. The narrow conventional sling loop 34 in FIG. 5 tends to fall down flat in a horizontal plane on top of trailer reach pole 30 making it hard to engage by the crane operator. The loop 34 is always of narrow configuration because hook 14 always engages the same point on the loop.

What is claimed is:

1. A lifting sling arrangement for an object to be lifted, said lifting sling comprising a length of stiff wire rope and a coupling connecting the ends thereof together in coaxial relation to form a closed loop, an arcuate guide track containing a portion of the sling for sliding movements of the sling in the guide track, said guide track comprising a channel member having a pair of radially outstanding apertured ears on the side walls of said channel member, an upstanding apertured lug mounted on the top side of said object, and a horizontal bolt pivotally interconnecting said pair of ears and said lug, said pivot bolt allowing said sling loop to pivot down against said top side of the object when the sling is not being lifted and said ears holding said sling loop in a vertical plane above said object for convenient engagement by a crane hook or grapple.

* * * * *